United States Patent [19]

Scott

[11] 3,993,306

[45] Nov. 23, 1976

[54] TENNIS TARGET STRUCTURE

[76] Inventor: Stanley Harold Scott, 3604 W. 95th St., Leawood, Kans. 66202

[22] Filed: Mar. 26, 1975

[21] Appl. No.: 562,132

Related U.S. Application Data

[63] Continuation-in-part of Ser. No. 488,423, July 15, 1974, abandoned.

[52] U.S. Cl. ..... 273/29 A

[51] Int. Cl.[2] ..... A63B 61/00

[58] Field of Search ..... 273/29 R, 105 R, 30, 273/26 A, 127 D, 127 R, 95 R, 29 A, 105 A

[56] References Cited

UNITED STATES PATENTS

| | | | |
|---|---|---|---|
| 3,215,432 | 11/1965 | Lee et al. | 273/29 A |
| 3,583,703 | 6/1971 | Brown | 273/26 A |

FOREIGN PATENTS OR APPLICATIONS

| | | | |
|---|---|---|---|
| 384,786 | 12/1932 | United Kingdom | 273/29 A |

*Primary Examiner*—Richard C. Pinkham
*Assistant Examiner*—T. Brown
*Attorney, Agent, or Firm*—Schmidt, Johnson, Hovey & Williams

[57] ABSTRACT

An improved, low cost, net-mounted tennis target structure is provided for improving tennis skills which permits practice on an otherwise unmodified regulation tennis court and allows the player to actually see the landing of his shot beyond the net which ensures that actual court conditions and "feel" are not lost during practice; in addition, the structure is adjustable for individual players and permits practice on specialized serves and ground strokes while ensuring that all such shots land within the appropriate court playing area beyond the net. While a single player can utilize the target structure to good effect as a practice aid, an opposing player can also simultaneously use the structure to give both players the benefit of return strokes so volleys of shots can be exchanged to accurately simulate actual conditions of competitive play. The target structure hereof includes an elongated, vertically adjustable strip adapted to be mounted above a tennis net to define a ball-clearing opening thereabove, with depending, laterally adjustable strips suspended therefrom which define target areas such that tennis balls propelled through the same land in a desired area within the confines of the court.

5 Claims, 5 Drawing Figures

TENNIS TARGET STRUCTURE

This is a continuation-in-part of application Ser. No. 488,423 filed July 15, 1974 now abandoned, and entitled Tennis Devices to Improve Skills.

This invention relates to simplified, low cost tennis target structures adapted to be mounted above a regulation tennis net for improving the skills of a novice or accomplished tennis player. More particularly, it is concerned with net-mounted target structure which permits one or more players to simultaneously use the same and simulate actual competitive play while moreover providing a highly visible target for the placement of tennis shots in desired areas within the playing area of an actual tennis court.

A number of devices have been proposed in the past for aiding the training of tennis players. Most of these devices have attempted to provide means for improving the accuracy of tennis shots so that the player can become more accomplished and adept at his sport, and a wide variety of different devices have been suggested.

For example, many of the tennis practice devices heretofore proposed have been of the rebound variety wherein an upright wall surface or the like is provided which presents a target for the player. Tennis balls shot against the wall surface rebound back towards the player and land on a previously marked foreground which determines whether the ball would have alighted within an imaginary court beyond the wall surface. One such device of this type is disclosed in U.S. Pat. No. 2,005,241 of Robinson.

Another type of tennis target structure provides an upright net or canvas barriers having a tennis ball-clearing opening therein with ball-catching means in the form of net or the like immediately therebehind. In these types of devices the player attempts to shoot tennis balls into the opening which is purportedly positioned so that a successful shot would land in the playing area of an actual tennis court. For example, in the patent of Bennett (Great Britain Pat. No. 384,786) an upright net structure with openings therein is provided which is adapted to be situated within a practice area. Good tennis shots which would fall within the playing area of an actual tennis court are supposed to pass through the openings in the Bennett device and be held within the pockets therebehind. A similar device is disclosed in the U.S. Pat. No. 3,215,432 of Lee et al. In this instance however, a number of flexible flaps cover the ball-clearing opening of the unit which are supposed to signify when hit by a tennis ball that the shot would have landed within a given area of an imaginary court therebeyond.

While some of the above described tennis target structures have achieved a certain degree of acceptance they nevertheless have been plagued by a number of deficiencies. The most persistant objection to these devices is that they create an unnatural practice situation for the player. That is, these units are not usable in conjunction with a regulation tennis court so that anyone using the same looses the feel of actual court conditions. Furthermore, the lack of adjustability in many of these units precludes the possibility that various specialized types of shots can be practiced. For example, while a given target device may permit practice on certain types of serves, it may not be properly dimensioned for the practice of overhand-spin serves or the like since such shots may have very different flight patterns as compared with other styles of serving. Furthermore, ground strokes such as forehands and backhands cannot successfully be practiced on fixed-dimension target structures since these shots characteristically have a much greater arc than serves and are shot from a position much closer to the playing surface. The problems noted above are of course accentuated when different players attempt to use a single target structure at different times. For example, a tall player who desires to practice serves having a high degree of top spin may require a target structure of certain dimensions, while a shorter player wishing to practice high-arc ground strokes would need a differently dimensioned target.

Another objection to the tennis target structures heretofore available stems from the fact that there is no simulation of actual competitive play during use thereof, and accordingly the practice is to a degree unnatural. That is, a practicing player should have the benefit of returning serves and other shots from an opponent in order to sharpen his skills, since this is the essence of the sport of tennis. It will therefore be appreciated that while a player may be proficient at the artificial "sport" provided by the fixed-dimension tennis targets heretofore available, he may be totally unfit for actual competitive play.

It is therefore the most important object of the present invention to provide an adjustable, net-mounted tennis target structure which can accommodate different players and permit practice on various types of tennis shots while also being used in conjunction with a regulation tennis net in an actual court setting so that the practicing player or players do not loose the feel of actual court conditions and can actually see where the tennis ball lands from practice shots on a standard court in order to better improve overall tennis skills.

Another object of the invention is to provide tennis target structure of the type described having a laterally extending upper strip which is situated above the net and vertically adjusted with respect to the latter so that the target structure is adjustable for individual players to permit practice on specialized serves or high-arc ground strokes and the like.

A still further object of the invention is to provide tennis target structure having depending, infinitely laterally adjustable strips suspended from the elongated laterally extending strip which define target areas of various desired dimensions such that tennis balls propelled through the same land in selected areas such as court alleys or the like but nevertheless within the bounded playing area of the court beyond the net, so that serves and other strokes can be "placed" with the greatest accuracy to ensure that the practicing player achieves the rhythm and feel necessary for well-placed shots in a competitive situation.

Another aim of the invention is to provide tennis target structure which permits practice by a single player as desired while also allowing simultaneous practice by two or four players so that all can have the benefit of actual return strokes such as would be experienced during actual competitive play; during such multi-player practice, all participants can attempt to place their shots in desired areas in their opponent's court area by shooting the ball through strategically placed target areas presented by the depending strips of taget structure so that specific shots such as cross-court shots can be practiced with maximum beneficial results.

Figure 1:
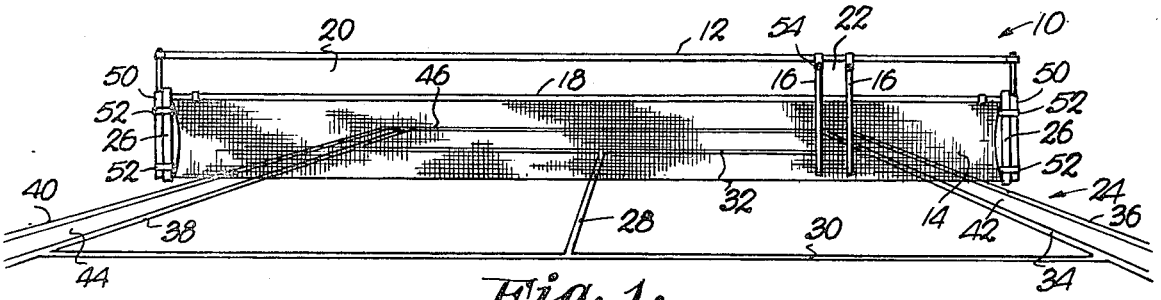
FIG. 1 is a perspective view of the regulation tennis court having a central net thereacross with the target structure of the present invention being mounted above the net and adjusted for the practice of serves.
Figure 2:
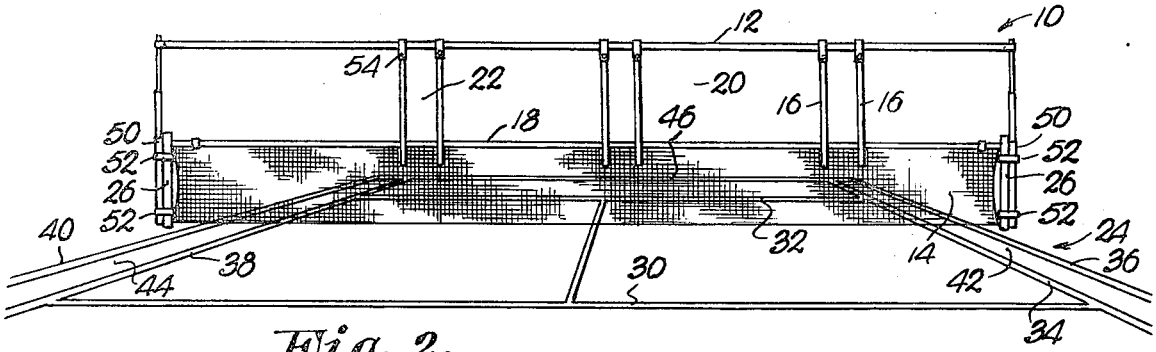
FIG. 2 is a perspective view identical to that depicted in FIG. 1 but showing the tennis target structure hereof adjusted for the practice of ground strokes.
Figure 3:
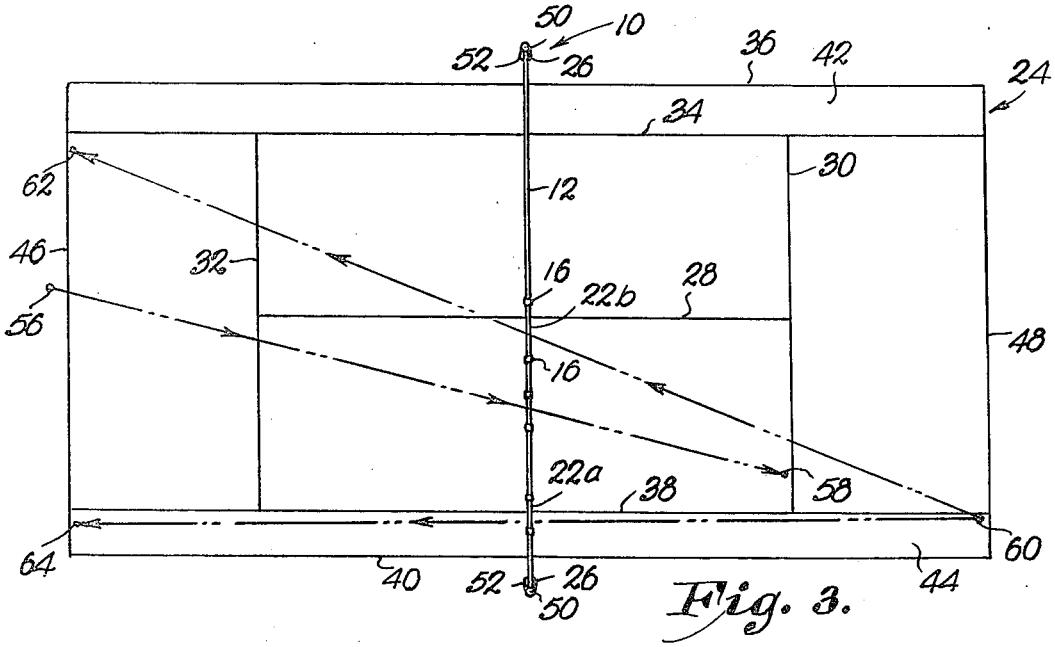
FIG. 3 is a plan view of the court depicted in FIGS. 1 and 2 and illustrating the path of tennis shots through the target areas defined by depending, target area-defining strips.
Figure 4:
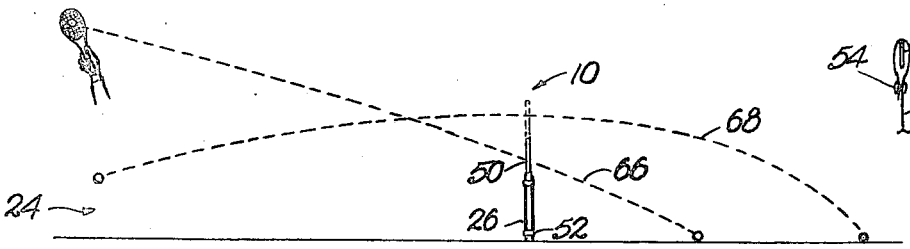
Figure 5:
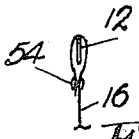

FIG. 4 is a side elevational view of the court illustrated in FIG. 3, showing an exemplary path of a serve through the tennis target structure when the latter is adjusted as illustrated in FIG. 1, and also the path of a ground-stroked ball through the structure when the latter is adjusted vertically upwardly as shown in FIG. 2; and FIG. 5 is a fragmentary side elevational view illustrating the connection of the depending strips to the laterally extending uppermost strip of the target structure.

Tennis target structure 10 is illustrated in FIGS. 1–4 and broadly includes an elongated strip 12 of brightly colored, flexible synthetic resin material which is of length to substantially span the distance between the opposing ends of a regulation tennis net 14. A plurality of spaced, depending strips 16 are suspended from the strip 12 and extend below the upper margin 18 of net 14. In this manner, an elongated tennis ball-clearing opening 20 is defined between upper margin 18 and strip 12, with specialized, smaller target openings 22 being defined between respective pairs of depending strips 16.

In more detail, it will be seen that target structure 10 is adapted to be mounted on a regulation tennis net forming a part of a tennis court 24. The latter includes net 14 as described which is stretched between opposed, upright posts 26 in the well known manner. Court 24 is bounded by a half court line 28, respective rear service lines 30 and 32 which are spaced from net 14 and parallel therewith, adjacent elongated sidelines 34, 36, and 38, 40 which define therebetween respective alleys 42 and 44, and rearmost base or backlines 46 and 48 which are likewise parallel with net 14.

A pair of vertically adjustable, multi-section telescoped standards 50 are provided for mounting strip 12 above net 14. A pair of spaced, conventional, removable retaining bands 52 are employed for releasibly securing the respective standards 50 to the end posts 26 as illustrated. The telescopically interfitted sections of the standard 50 can be selectively extended or retracted as will be seen from a comparison of FIGS. 1 and 2 in order to vary the height thereof relative to the upper margin 18 of net 14 to thereby correspondingly vary the height of elongated ball-clearing opening 20. Furthermore, the standards 50 can be releasibly locked in any desired vertical position by means of any well known expedient such as conventional set screws extending through the outer tubular sections to hold the adjacent inner sections in selected positions. In addition, and referring specifically to FIG. 5, it will be seen that each strip 16 is merely looped about elongated strip 12 and snapped together as at 54 in order to permit infinite lateral adjustment of the strips 16 as desired.

In use, it is only necessary to secure the respective standards 50 in position adjacent the net posts 26 by means of the clamps 52. The telescopic sections of the standard 50 are then extended to a desired height and locked into position and strip 12 affixed thereto. Finally, two or more depending strips 16 are attached to elongated strip 12 and arranged as desired to provide one or more target areas.

In the case where a player wishes to practice serves, structure 10 may be adjusted so that strip 12 is situated at illustrated FIG. 1. In this orientation strip 12 is positioned so that all service-stroked balls passing through ball-clearing opening 20 (from the forward side of net 14 as viewed in FIG. 1) will land short of service line 32 so that the player can practice his serves and develop the needed accuracy. In addition, should the player wish to practice serves which land in only a given area of the corresponding service area beyond the net the strips 16 can be arranged to provide the appropriate target opening 22. This type of shot practice can best be seen from a study of FIG. 3. For example, a player could stand at a given service point 56 and practice his serves which would land within the opposite cross-court service area short of line 30, as at point 58. This practice is continued until the player achieves the necessary rhythm and accuracy for placing his serve in actual competitive play, whereupon other shots as ground strokes or the like could be practiced.

In other instances a player may wish to practice ground strokes which could optionally go to either the left or righthand side of the opposing court area. For example, a player hitting a ground stroke from point 60 (FIG. 3) may wish to return the same to the far right-hand corner of the court to point 62 of down alley 44 to point 64. In this case, four strips 16 could be arranged to provide separate target openings **22*a* and 22*b*** which could optionally be used by the player to practice the respective shots.

One particularly important aspect of the present invention stems from the fact that the same can be used by one or more players. For example, if it is desired to utilize structure 10 in a match-type situation, the structure 10 may be adjusted to the ground-stroke position of FIG. 12. At this point the player will serve the tennis ball through opening 20 (which at this time would not be at a level ensuring a no-fault serve within the opposite service area) whereupon the two players can exchange a volley of shots through the respective target openings. This not only serves to sharpen the skills of both players since they have a well-defined area to shoot at above the net 14, but moreover they are able to accomplish this in a simulated competition situation which is impossible to achieve in the case of conventional rebound-type target structures or the like. It is also significant that the players retain the court feel throughout their practice and are not subjected to an artificial practice situation.

It will also be appreciated that the inherent adjustability of target structure hereof permits use thereof by all types of tennis players wishing to practice various types of serves and ground strokes. This adjustability has been found necessary by virtue of the fact that all tennis shots have a characteristic path of travel based upon their initial velocity and the arc imparted thereto. Referring to FIG. 4 it will be seen that a regular serve may follow a generally flat path of travel 66 (which nevertheless is somewhat curved by virtue of gravity deflection), while on the other hand a ground stroke may follow an arced path 68. Furthermore, the characteristic flight paths can vary considerably between different players by virtue of differences in height, weight, and the type of spin normally imparted to the tennis ball during play. Thus, a fixed dimensioned tennis target is inherently incapable of serving as an adequate teaching device for all types of players, and the adjustability of the present structure 10 permits correlation of ball-clearing opening 20 and the respective target openings 22 to a particular player's stature, ability, and practice needs.

Having thus described the invention, what is claimed as new and desired to be secured by Letters Patent is:

1. Tennis target structure adapted to be used with a regulation tennis net situated centrally within a tennis court, the latter having opposed service areas on either side thereof defined in part by respective rear service lines spaced from the net and parallel therewith, and respective rearmost backlines parallel with said net and spaced therefrom farther than said rear service lines of the corresponding service areas, said target structure comprising:

at least one strip of length to substantially span the length of said net;

means for mounting said strip above the upper margin of said net and along the length thereof to define a tennis ball-clearing opening above said net, and for permitting the selective vertical adjustment of said strip to vary the distance between the latter and said upper margin to thereby correspondingly vary the dimensions of said opening, said strip being adjustable between positions wherein tennis ball service-stroked from either side of said net through said opening will land short of the rear serviceline of the service area on the opposite side of said net, to positions wherein tennis balls groundstroked from either side of said net will land short of the backline on the opposite side of said net;

a plurality of spaced, generally vertically disposed strips extending downwardly therefrom said first-mentioned strip to present target openings between the vertically disposed strips permitting tennis balls propelled from either side of said net to pass through said target openings and land in selected areas within the playing area of said tennis court on said opposite side of said net; and means mounting said vertically disposed strips for lateral adjustment thereof in order to vary the dimensions of said target openings therebetween, said structure being constructed for permitting tennis balls to travel in an unimpeded fashion from either side of said net, through said ball-clearing and target openings, and onto said court on said opposite side of said net, whereby opposing players may simultaneously utilize said target structure.

2. The tennis target structure as set forth in claim 1 wherein only a single net-spanning strip is employed.

3. The tennis target structure as set forth in claim 1 wherein said vertically disposed strips are infinitely laterally adjustable.

4. In a regulation tennis court having a centrally located, upright net, opposed service areas on either side of the net defined in part by respective rear service lines spaced from the net and parallel therewith, and respective rearmost backlines parallel with the net and spaced therefrom farther than said respective rear service lines of said service areas, the combination of a net and tennis target structure which comprises:

at least one strip of length to substantially span the length of said net;

means for mounting said strip above the upper margin of said net and along the length thereof to define a tennis ball-clearing opening above the net, and for permitting the selective vertical adjustment of said strip to vary the distance between the latter and said upper margin to thereby correspondingly vary the dimensions of said opening, said strip being adjustable between positions wherein tennis balls service-stroked from either side of the net through said opening will land short of the rear service line of the service area on the opposite side of the net, to positions wherein tennis balls groundstroked from either side of the net will land short of the backline on the opposite side of the net;

a plurality of spaced, generally vertically disposed strips extending between said first-mentioned strip and at least the upper margin of said net to present target openings between the vertically disposed strips permitting tennis balls propelled from either side of the net to pass through the target openings and land in selected areas within the playing area of the tennis court on the opposite side of the net; and means mounting said vertically disposed strips for lateral adjustment thereof in order to vary the dimensions of said target openings therebetween, said structure being constructed for permitting tennis balls to travel in an unimpeded fashion from either side of said net, through said ball-clearing and target openings, and onto the court on the opposite side of said net, whereby opposing players may simultaneously utilize the target structure.

5. Apparatus for perfecting tennis skills, comprising:

an upright tennis-type net;

at least one strip of length to substantially span the length of said net;

means for mounting said strip above the upper margin of said net and along the length thereof to define a tennis ball-clearing opening above the net, and for permitting the selective vertical adjustment of said strip to vary the distance between the latter and said upper margin to thereby correspondingly vary the dimensions of said opening, said strip being adjustable between positions wherein tennis balls service-stroked from either side of the net through the opening will land within a playing area on the opposite side of the net to positions wherein tennis balls ground-stroked from either side of the net will land in said playing area on the opposite side of the net;

a plurality of spaced, generally vertically disposed strips extending downwardly from said first-mentioned strip to present target openings between the vertically disposed strips permitting tennis balls propelled from either side of said net to pass through the target openings and land in selected areas within said tennis-playing area on the opposite side of said net; and means mounting said vertically disposed strips for lateral adjustment thereof in order to vary the dimensions of said target openings therebetween, said apparatus being constructed for permitting tennis balls to travel in an unimpeded fashion from either side of said net, through said ball-clearing and target opening, and onto the tennis-playing area on the opposite side of said net, whereby opposing players may simultaneously utilize the apparatus.

* * * * *